United States Patent [19]

Esselman et al.

[11] 4,423,703

[45] Jan. 3, 1984

[54] STEAM GENERATOR OR LIKE APPARATUS INCLUDING SELF-CLEANING HEATING ELEMENT SUPPORT ARRANGEMENT

[75] Inventors: Walter H. Esselman, Los Altos; Stanley J. Green, Palo Alto, both of Calif.

[73] Assignee: Electric Power Research Institute, Inc., Palo Alto, Calif.

[21] Appl. No.: 241,565

[22] Filed: Mar. 9, 1981

[51] Int. Cl.[3] ..... F28F 13/08; F28F 1/00

[52] U.S. Cl. ..... 122/510; 122/512; 165/134 R; 165/162; 165/156

[58] Field of Search ..... 122/510, 512, 406 R; 165/162, 156, 134 R

[56] References Cited

U.S. PATENT DOCUMENTS

| | | | |
|---|---|---|---|
| 1,804,624 | 5/1931 | King | 165/156 |
| 2,832,570 | 4/1958 | Schoessow | 165/162 |
| 2,908,486 | 10/1959 | Thornburg | 165/156 |
| 3,270,806 | 9/1966 | Borrini | 165/156 |
| 3,566,615 | 3/1971 | Roeder, Jr. | 165/156 |
| 3,907,026 | 9/1975 | Mangus | 165/134 |
| 4,120,350 | 10/1978 | Norton | 165/162 |
| 4,191,246 | 3/1980 | Cassell | 165/162 |
| 4,256,783 | 3/1981 | Takada et al. | 165/162 |

*Primary Examiner*—Henry C. Yuen

*Attorney, Agent, or Firm*—Flehr, Hohbach, Test, Albritton & Herbert

[57] ABSTRACT

A steam generating apparatus including a housing defining an inner chamber adapted to receive a continuous supply of water and containing a plurality of elongated heating elements within the chamber for converting the water to steam is disclosed herein. The housing also contains within its chamber a number of spaced plates for supporting the heating elements which extend through cooperating openings in the plates. In order to minimize the accumulation of corrosion material in the crevices around the junctures between the tubes and support plates, a helical groove is provided along the length of each opening around an associated heating element so that water and/or converted steam passing through these openings do so within the grooves whereby to cleanse their crevices of corrosion material.

6 Claims, 7 Drawing Figures

STEAM GENERATOR OR LIKE APPARATUS INCLUDING SELF-CLEANING HEATING ELEMENT SUPPORT ARRANGEMENT

The present invention relates generally to steam generators or like apparatus in which a continuous supply of water is converted to steam or otherwise heated by means of elongated heating elements extending through and supported by a number of spaced support plates. The present invention relates more particularly to a specific technique for reducing and preferably preventing corrosion or like material from accumulating in the crevices at the junctions of the heating elements and support plates.

The typical PWR steam generator presently in use utilizes a housing defining an inner chamber adapted to receive a continuous supply of water through a cooperating inlet. The housing chamber contains a plurality of heating tubes adapted to pass coolant from a nearby reactor for converting the water to steam. These heating tubes extend through and are supported by a number of spaced apart plates disposed within the chamber between its inlet and an outlet through which the converted steam passes on its way to an adjacent steam driven turbine. As the water passes through the chamber and is converted to steam it leaves behind a certain amount of corrosion material which tends to accumulate in the crevices at the junctions of the heating tubes and support plates, as indicated above. This buildup of material has the tendency to cause corrosion of the support plates which lead to denting of the heating tubes and possibly the eventual structural failure of their associated support plates.

In view of the foregoing, it is the primary object of the present invention to reduce and preferably entirely prevent the previously described accumulation of corrosion or like material during operation of the steam generator of the type described or other apparatus utilizing similar configurations to heat water or other liquids.

A more particular object of the present invention is to provide an uncomplicated and yet reliable technique for continuously cleansing the heating element/support plate crevices in steam generating and like apparatus of corrosion or like material during operation of the apparatus whereby to prevent the buildup of such material.

As will be described in more detail hereinafter, the way in which the previously recited crevices are cleansed in accordance with the present invention is by causing water and/or steam within the apparatus chamber to pass through the support plate openings along helical paths around the outer surfaces of associated heating elements.

This is accomplished by providing the side wall of each opening with a helical groove extending the length of the latter as will be discussed in more detail in conjunction with the drawing wherein.

Figure 1:
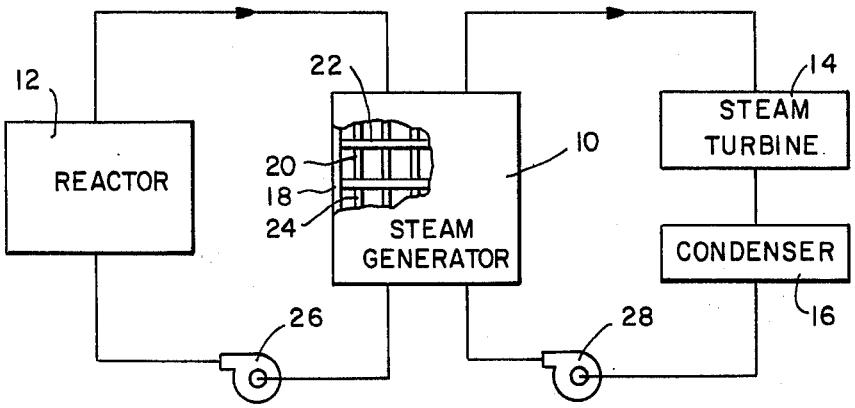
FIG. 1 is a diagrammatic illustration of a "Once Through" steam generator designed in accordance with the present invention in combination with a nuclear reactor, a steam turbine and a condenser.

Turning now to the drawings, attention is first directed to FIG. 1 which, as stated above, diagrammatically depicts a steam generator designed in accordance with the present invention, a nuclear reactor, a steam turbine and a condenser. The generator itself is designated by the reference numeral 10 while the reactor is shown at 12, the steam turbine at 14 and the condenser at 16. The steam generator is of the general type described above, that is, it includes an outer housing 18 defining an inner chamber 20, a plurality of spaced apart, parallel support plates 22 disposed within the chamber and a plurality of elongated heating elements 24. Each support plate includes an equal plurality of openings to be described hereinafter with respect to FIG. 2. The heating elements in the form of tubular members or tubes are also disposed within chamber 20 and extend through cooperating ones of the openings just mentioned so as to be held in place by the various support plates.

The steam generator thus far described is one which is known in the art as the "Once Through" type as indicated above. The lowermost and uppermost ends of tubes 24 are respectively placed in fluid communication with inlet and outlet plenums (not shown) which are separate from chamber 20. The inlet plenum is adapted to receive a continuous supply of hot coolant from reactor 12 through a cooperating inlet (also not shown) by means of a circulation pump 26 or the like. Hot coolant from the reactor passes into the inlet plenum and thereafter through the tubes 24 simultaneously. The coolant returns to the reactor through the outlet plenum of the steam generator and a cooperating outlet (also not shown). In this way, the tubes serve as heating elements. At the same time, water is pumped or otherwise caused to flow by suitable means such as pump 28 through chamber 20 outside and over tubes 24 along a circulation path which includes the steam turbine and condenser. More specifically, water from the condenser is converted to steam by the heating tubes in chamber 20. The converted steam and any water which is not converted pass into turbine 14 wherein the steam is used to drive the turbine and therefore produce electrical power. This combination of steam and water thereafter enters the condenser where the steam is condensed and the process is repeated.

Figure 2:
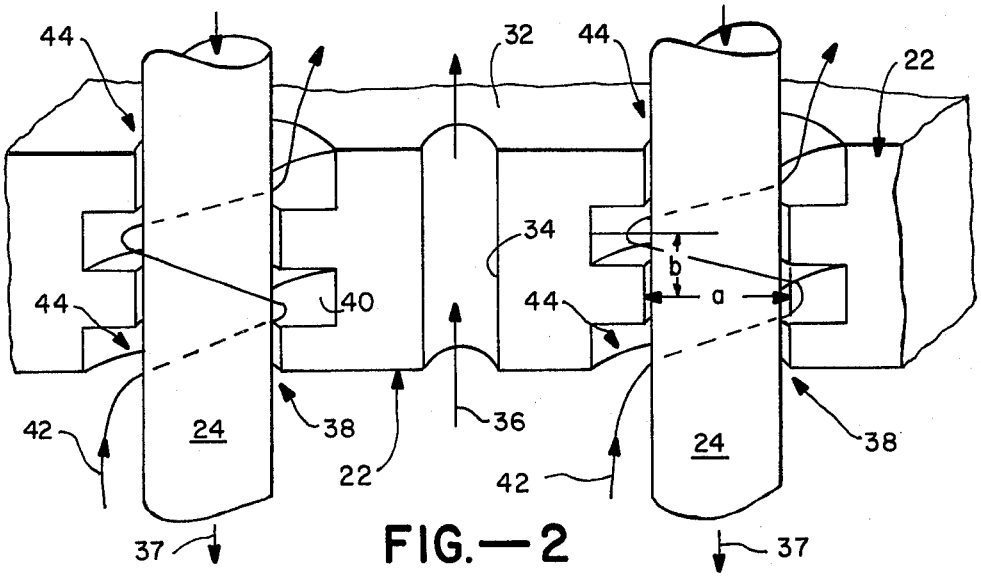
FIG. 2 is an enlarged perspective view of two heating tubes and an associated support plate comprising part of the steam generator of FIG. 1 and designed to minimize and preferably eliminate the accumulation of corrosion material in the crevices located at the junctions of the tubes and support plate.

Having described steam generator 10 in a general way, attention is directed specifically to one of the support plates 22 which, as stated previously, is designed in accordance with the present invention. As seen in FIG. 2, the support plate illustrated there includes an underside 30, an opposite topside 32 and optionally, an unobstructed opening 34 through which water and/or converted steam passes on its way through chamber 20, as indicated by arrows 36. The plate 22 illustrated in FIG. 2 also includes a plurality of openings generally indicated at 38 through which the tubes 24 pass. The arrows 37 indicate the flow of hot coolant from reactor 12.

In accordance with the present invention, a helical groove 40 is located in and extends the length of the side wall defining each opening 38, in confronting relationship with and opening towards the outer surface of its associated tube 24. In this way, most if not all of the water which passes through opening 38 from the underside 30 of plate 22 through its topside does so along a helical path generally indicated by the arrow 42 within and defined by a groove 40. These grooves are provided in each tube receiving opening in each support plate 22. This controlled flow of water through each of these openings and around each associated tube continues throughout the operation of generator 10, that is, so long as the water and/or steam is circulated through chamber 20. In this way, the crevices 44 at the junctions between the support plates at tubes are continuously cleansed of corrosion or like material, thereby preventing a buildup of this material which, in turn, eliminates the possibility of corrosion either to the tubes or the support plates which might otherwise result.

Figure 3A:
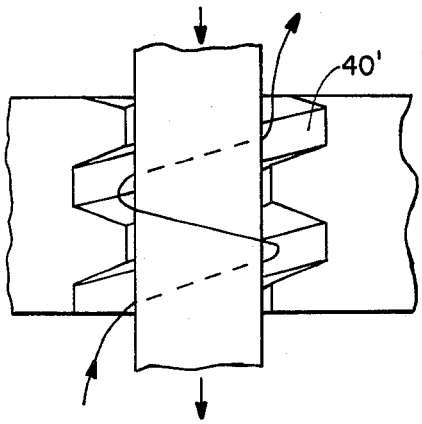
FIGS. 3A and 3B are vertical plan views of modified support plates.
Figure 3B:
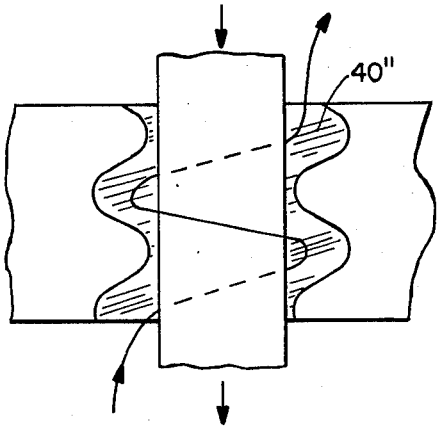

In the particular embodiment illustrated in FIG. 2, the helical grooves 40 are shown having square cross sections. These grooves can be readily provided in the support plates by machining square type threads of the appropriate size into the side walls of openings 38. In a similar manner, grooves having acme-like cross sections can be provided, as in FIG. 3A, or the grooves can have rounded cross sections, as in FIG. 3B. In this latter case, the amount of tube surface which is actually washed by the continuous flow of water is maximized. In any of these cases, the flow path should be designed to allow a sufficient liquid velocity and quantity to wash to surfaces where corrosion products could develop. For example, in the embodiment illustrated in FIG. 2, the flow rate through each channel 44 is a function of its pitch (b/a) and its cross-sectional area. Either or both of these parameters could be varied for any given tube receiving opening in order to provide the desired flow rate which obviously also depends upon the pressure differential across the opening. Both the pitch and cross-sectional area of each of the grooves illustrated in FIGS. 3A and 3B can be varied in the same manner. In this regard, the groove illustrated in FIG. 3A is generally indicated by the reference numeral 40' and the groove illustrated in FIG. 3B is illustrated by the reference numeral 40''.

In addition to partly controlling the flow rate through each tube opening 38 (clearance between the tube OD hole ID) by manipulating the pitch and cross-sectional area of its associated channel, the flow rate through these openings in any given plate can also be controlled by the number and size of unobstructed openings 34 provided therein. As a limiting case, it may be desirable to cause all water which crosses a given plate to do so through the tube openings 38 only. This may be desirable for example in some areas of chamber 20 where a large amount of corrosion or like material tends to otherwise accumulate. In these areas, the plates 22 can be provided without openings 36 and their outermost peripheries can be maintained in a sealed relationship with the walls of the chamber so that water does not pass therebetween.

Figure 4:
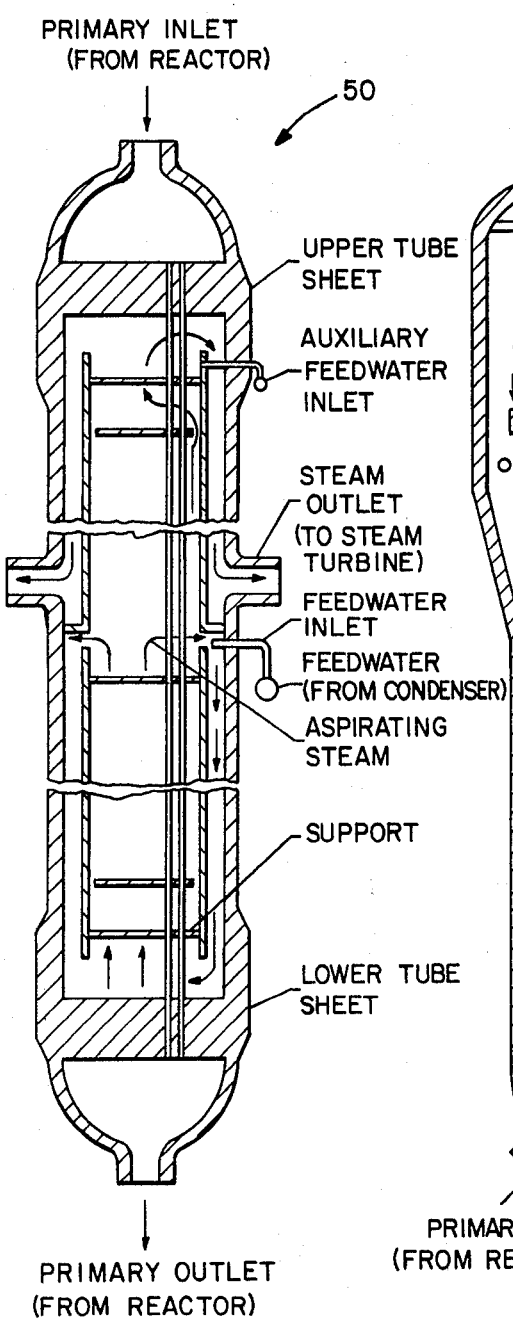
FIGS. 4 and 5 illustrate actual "once through" and "recirculating" steam generators in cross-section.
Figure 5:
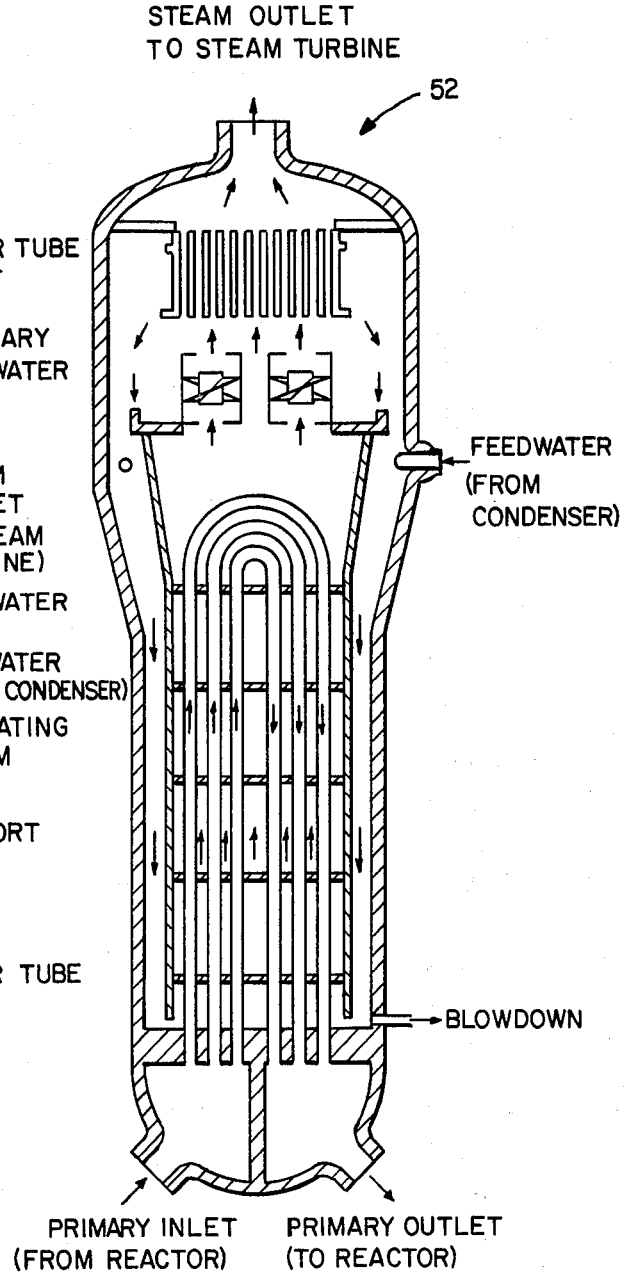

The present invention has been described with respect to a "Once Through" steam generator in association with a nuclear reactor, a steam turbine and a condenser. It is to be understood however that the present invention is equally applicable for use in other types of steam generators such as the "Recirculating" type or other such apparatus utilizing similar tube/plate configurations in which water or other liquid caused to cross the plates results in the possible accumulation of foreign material in the tube/plate crevices. An actual and readily providable steam generator of the "Once-through" type is illustrated in FIG. 4 at 50 while FIG. 5 illustrates a readily providable steam generator of the "recirculating" type at 52.

What is claimed is:

1. A steam generating apparatus comprising: a housing including an inner chamber and inlet and outlet means into and out of said chamber, respectively; a plurality of support plates disposed within said chamber in spaced relationship to one another between said inlet and outlet means, each of said support plates including a plurality of openings and a helical groove extending the length of and located in the side wall defining each of said openings; a plurality of elongated tubular members, equal in number to said plurality of openings, disposed within said chamber and extending through associated openings in said support plates, each of the side walls of said openings and the outer surface of its associated tubular member cooperating with one another so that the only passageway for water therebetween is through its helical groove; means for supplying a continuous stream of hot fluid through each of said tubes whereby the latter serve as heating elements; and means for causing water having a certain amount of dissolved solid material therein to pass into said chamber through said inlet means whereby to be converted to steam by said heating elements such that the dissolved solid material from the converted steam accumulates within said chamber and across said plates toward said outlet means, said grooves being such that at least some of said water and/or converted steam passes through and along each of said helical grooves with sufficient force to clean the crevices at the junctures of said tubular members and support plates of any of said solid material.

2. An apparatus according to claim 1 wherein at least some of said plates include second pluralities of unobstructed openings whereby to pass some of said water and/or converted steam and wherein at least one of said plates includes only said first-mentioned openings, said one plate cooperating with said housing such that any water and/or steam passing across said one plate must do so through only the grooves in its openings.

3. In an apparatus according to claim 1 wherein said heating elements are hollow tubes adapted to pass continuous streams of hot fluid therethrough, said tubes being free of any obstructions to the passage of said fluid.

4. In an apparatus according to claim 1 wherein each of said grooves has a square cross-sectional configuration.

5. In an apparatus according to claim 1 wherein each of said grooves has a rounded cross-sectional configuration.

6. In an apparatus according to claim 1, wherein each of said grooves has an acme-type of cross-sectional configuration.

* * * * *